US006664017B1

(12) United States Patent
Patel et al.

(10) Patent No.: US 6,664,017 B1
(45) Date of Patent: Dec. 16, 2003

(54) DOCUMENT SECURITY PROCESSES

(75) Inventors: Raj D. Patel, Oakville (CA); Michael A. Hopper, Toronto (CA); H. Bruce Goodbrand, Hamilton (CA); Kurt I. Halfyard, Mississauga (CA); Nan-Xing Hu, Oakville (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/225,411

(22) Filed: Aug. 20, 2002

(51) Int. Cl.[7] ..... G03G 9/097

(52) U.S. Cl. ..... 430/120; 430/137.14; 430/10; 430/108.1

(58) Field of Search ..... 430/120, 137.14, 430/10, 108.6, 108.1, 108.2

(56) References Cited

U.S. PATENT DOCUMENTS

| | | | | |
|---|---|---|---|---|
| 3,674,736 A | | 7/1972 | Lerman et al. | 260/41 R |
| 4,796,921 A | | 1/1989 | Neiman | 283/91 |
| 5,208,630 A | | 5/1993 | Goodbrand et al. | 355/201 |
| 5,225,900 A | | 7/1993 | Wright | 358/75 |
| 5,278,020 A | | 1/1994 | Grushkin et al. | 430/137 |
| 5,290,654 A | | 3/1994 | Sacripante et al. | 430/137 |
| 5,308,734 A | | 5/1994 | Sacripante et al. | 430/137 |
| 5,344,192 A | | 9/1994 | Phillips | 283/91 |
| 5,344,738 A | | 9/1994 | Kmiecik-Lawrynowicz et al. | 430/137 |
| 5,370,963 A | | 12/1994 | Patel et al. | 430/137 |
| 5,403,693 A | | 4/1995 | Patel et al. | 430/137 |
| 5,492,370 A | * | 2/1996 | Chatwin et al. | 283/110 |
| 5,554,480 A | | 9/1996 | Patel et al. | 430/137 |
| 5,695,220 A | | 12/1997 | Phillips | 283/91 |
| 5,826,916 A | | 10/1998 | Phillips | 283/91 |
| 5,910,387 A | | 6/1999 | Mychajlowskij et al. | 430/110 |
| 5,916,725 A | | 6/1999 | Patel et al. | 430/137 |
| 5,919,595 A | | 7/1999 | Mychajlowskij et al. | 430/137 |
| 5,925,488 A | | 7/1999 | Patel et al. | 430/137 |
| 5,977,210 A | | 11/1999 | Patel et al. | 523/161 |
| 6,458,165 B1 | * | 10/2002 | Foucher et al. | 430/108.21 |

* cited by examiner

*Primary Examiner*—John Goodrow
(74) *Attorney, Agent, or Firm*—E. O. Palazzo

(57) ABSTRACT

A process comprising applying a toner security mark on a document generated by xerographic means and which mark possesses white glossy characteristics, and wherein said toner is comprised of a polymer and a colorant.

38 Claims, No Drawings

DOCUMENT SECURITY PROCESSES

CROSS REFERENCE

There is illustrated in copending U.S. Ser. No. 10/225,408, filed Feb. 21, 2003, the disclosure of which is totally incorporated herein by reference, a process comprising generating on a substrate a security mark comprised of a glossy ink containing a colorant; and in U.S. Ser. No. 10/225,214, filed Feb. 21, 2003, entitled Document Security Processes, filed concurrently herewith, the disclosure of which is totally incorporated herein by reference, a process comprising applying a toner security mark on a document generated by xerographic means and which mark possesses white glossy characteristics, and wherein said toner is comprised of a waterborne polymer and a colorant.

BACKGROUND

The present invention is directed to processes, and more specifically, to processes wherein a component of, for example, a white glossy toner mark wherein glossy refers, for example, to a gloss values of about 75 to about 140 gardiner gloss unit (GGU) as measured by a gloss meter at an angle of about 75, and more specifically, from about 80 to about 130 GGU degrees when placed on a substrate, such as paper, is visibly detectable by, for example, the eye when viewed at any angle of, for example about 10 to about 85 degrees, and more specifically, from about 35 to about 65 degrees. The viewing angle refers, for example, to the angle as measured perpendicular to the document security mark. Optionally the substrate can contain a second toner mark which is not visible to the eye, and which mark is detectable, that is when, for example, radiated with UV light the mark is visible to the eye. Documents containing such marks when reproduced xerographically result in the absence of the white glossy marks or the marks appear as a dull gray mark indicating a fake.

In embodiments, the process of the present invention comprises the xerographic generation of documents, such as tickets like tickets to sports activities, coupons, classified papers, currency, and the like, by the formation of a security mark, water mark, indicia thereon, and which mark when dried possesses a white shiny or glossy surface where shiny or glossy refers, for example, as having a highly reflective surface wherein most, over 50 percent, of the incident light is reflected from the surface, and wherein the mark is more glossy compared to the remainder of the document and wherein duplication, or counterfeiting thereof by, for example, xerography, ink jet printing, and the like will result in the absence of the security mark or the security mark may appear as a dull black/grey mark thereby indicating that the document is not authentic and is a forgery or fake. Accordingly, the use of costly sophisticated instruments to authenticate the mark can be avoided since the security mark generated with the processes disclosed herein can be detected visually. Moreover, in embodiments a plurality of security marks may be included in the document, wherein plurality refers to at least 2, and can be from about 2 to about 10, and more specifically, from about 2 to about 6, and yet more specifically, about 2 to about 4.

REFERENCES

Illustrated in U.S. Pat. No. 5,208,630, the disclosure of which is totally incorporated herein by reference, are processes for the authentication of documents, such as tickets, credit cards, and the like, by generating these documents with a toner containing an infrared light absorbing component, which compositions are detectable when exposed to radiation outside the visible wavelength range, and more specifically, a wavelength of from between about 650 to 950 nanometers.

Illustrated in U.S. Pat. No. 5,225,900, the disclosure of which is totally incorporated herein by reference, is a process for controlling a reproduction system comprising scanning an image to detect at least one taggant in at least one marking material forming the image; issuing instructions to a reproduction system, and which instructions cause the reproduction system proceed in a certain manner.

Further, of interest is U.S. Pat. No. 5,554,480, which discloses, for example, a toner containing a UV pigment, and U.S. Pat. Nos. 5,344,192; 5,826,916; 5,695,220 and 4,796,921, the disclosures of which are totally incorporated herein by reference.

SUMMARY

It is a feature of the present invention to provide processes for the generation of images on a number of documents.

Also, it is another feature of the present invention to provide permanent security marks on documents.

It is yet another feature of the present invention to provide a visible mark on security documents, such as tickets, coupons, identification badges, passes, negotiable securities, and the like, and which mark or marks are formed by a composition comprised of a white pigment and a polymer which when fused form a white glossy mark which is visible to the eye at any angle, irrespective of the light source location and an optional further security mark which is not visible to the naked eye, which mark is comprised, for example, of toners containing a component that fluoresces under an ultraviolet light, wherein the component can be either a pigment or a dye that is excited in the ultraviolet region of the light spectrum of a wavelength of from about 200 to about 400 nanometers and also fluoresces at about 400 to about 700 nanometers in the visible spectral region.

Additionally, it is another feature of the present invention to provide processes that prevent the duplication of documents, including security documents, like tickets, coupons or credit cards.

Another feature of the present invention is to provide processes for determining the authenticity of documents, such as tickets, coupons, credit cards, security badges, and the like.

Further, in another feature of the present invention there are provided security marks comprised of white toners.

Moreover, in yet another feature of the present invention there are provided covert document authentication processes wherein selected areas, or words of documents can be readily and rapidly distinguished from the remainder of the document and also a second mark detectable by, for example, illuminating this mark with a UV device, thereby enabling security or special coding of the document. The colorants selected for the second mark in embodiments are those that fluoresce under ultraviolet light, that is, for example, from about 200 nanometers to about 400 nanometers.

It is still another feature of the present invention to provide toners generated by emulsion/aggregation/coalescence processes, and which toners can provide a means for placing coded information on a document, and which compositions can be selected for trilevel color imaging processes.

Aspects of the present invention relate to a process comprising applying a toner security mark on a document generated by xerographic means, and which mark possesses white glossy characteristics, and wherein the toner is comprised of a polymer and a colorant; a process wherein the mark is present on a coupon, or currency; a process wherein the colorant is a white pigment present in an amount of from about 10 to about 40 percent pigment, and the polymer is present in an amount of from about 90 to about 60 percent; a process wherein the colorant is a white pigment present in an amount of from about 20 to about 30 percent pigment wherein the polymer is present in an amount of from about 80 to about 70 percent, and wherein the total of the two components is about 100 percent; a process wherein the mark is visible when viewed at angles of from about 15 to about 85 degrees from the perpendicular; a process wherein the viewing angle is from about 35 to about 65 degrees; a process wherein the polymeric resin possesses a molecular weight $M_w$ of about 15,000 to about 40,000; a security process including a second security mark containing a polymer and a UV fluorescent colorant; a process wherein the colorant is a white pigment of titanium dioxide, aluminum oxide, zirconium oxide or zinc oxide; a process wherein the white pigment is titanium dioxide present in an amount of about 20 to about 30 percent by weight of toner, and there is present about 80 to about 70 percent polymer resin; a process wherein the UV excited fluorescent pigment is present in an amount of about 3 to about 8 weight percent by weight of toner; a process wherein the UV fluorescent pigment is initially invisible, and subsequently rendered visible when subjected to UV light; a process wherein the UV pigment is selected from the group consisting of 4,4'-bis(styryl)biphenyl, 2-(4-phenylstilben-4-yl)-6-butylbenzoxazole, beta-methylumbelliferone, 4-methyl-7-dimethylaminocoumarin, 4-methyl-7-aminocoumarin, N-methyl-4-methoxy-1,8-naphthalimide, 9,10-bis(phenethynyl)anthracene, and 5,12-bis(phenethynyl) naphthacene; a process wherein the polymer is a styrene-butylacrylate-beta carboxyl ethyl acrylate; a process comprising applying a security mark on a document and which mark possesses white glossy characteristics, and wherein the mark is visible and contains a pigment embedded in a polymer and a second toner mark which contains a colorant that fluoresces under UV light; a process comprising providing a security mark or marks on a document generated xerographically, and which mark is comprised of a glossy toner containing a polymer and a pigment; a process wherein the polymer is a styrene acrylate, a styrene methacrylate, a styrene butadiene, or a polyester; a process wherein the polymer is a styrene acrylate; a process wherein the polymer is a methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes; a process wherein the polymer is present in an amount of from about 65 to about 85 weight percent; a process wherein the glossy mark value is from about 65 to about 99 GGU as measured at an angle of 75 degrees; a process wherein the glossy mark value is from about 75 to about 140 GGU as measured at an angle of 75 degrees; a process wherein the polymer is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylateacrylononitrile), and poly(styrene-butyl acrylate-acrylononitrile-acrylic acid); a process wherein a barcode is contained on the surface of the security mark; a process wherein the barcode is situated below the UV fluorescent security mark; a process wherein the security mark is located at various positions on the document; a process for avoiding the copying of a document by providing a security mark on the document, and which mark is comprised of a glossy toner containing a pigment and optionally a second mark containing a UV sensitive pigment; a process wherein the documents to which security marks are applied are tickets, coupons, identification badges, passes, or negotiable securities; a process wherein the security mark is viewed at an angle of from about 15 to about 85 degrees of the light source; a process wherein the white glossy mark is generated from a toner which is prepared by (i) blending a latex emulsion with a white colorant dispersion comprised of submicron, about for example 0.05 to about 1 micron in diameter, particles suspended in a nonionic surfactant and water, and optionally adding a wax dispersion comprised of submicron wax particles dispersed in an ionic surfactant of a similar charge polarity to that of the ionic surfactant in the latex emulsion, and wherein the latex contains submicron resin particles, an ionic surfactant and water;

(ii) adding to the blend two coagulants of a polymetal halide dissolved in a strong acid and an ionic surfactant of opposite charge polarity to that of the latex surfactant and pigment ionic surfactant to initiate flocculation of the latex and the white particles;

(iii) heating the resulting mixture below the glass transition temperature (Tg) of the latex resin to form toner sized aggregates;

(iv) optionally adding a latex to the formed toner aggregates;

(v) adjusting the pH of the toner aggregates from about 1.8 to about 3 to a pH value of about 6.5 to about 8 with a base;

(vi) heating the resulting aggregate suspension of (v) to above the Tg of the latex resin; and (vii) retaining the temperature of the mixture (vi) from about 70 to about 95° C., followed by a reduction of the pH to about 4.8 to about 6, and then optionally retaining the temperature for a period of about 0.5 to about 6 hours; a process wherein the colorant is a UV fluorescent component, and wherein the toner is prepared by (i) blending a latex emulsion with a UV fluorescent component comprised of submicron particles suspended in nononic surfactant and water, and optionally adding a wax dispersion comprising submicron wax particles dispersed in an ionic surfactant of similar charge polarity to that of the ionic surfactant in the latex emulsion; and wherein the latex is comprised of submicron resin particles of styrene-butylacrylate-beta carboxyl ethyl acrylate dispersed in an ionic surfactant and water;

(ii) adding to the blend a polyaluminum chloride dissolved in nitric acid and an ionic surfactant of opposite charge polarity to that of the latex surfactant blend to initiate flocculation of latex and pigment particles;

(iii) heating the resulting mixture below the glass transition temperature (Tg) of the latex resin;

(iv) optionally adding a latex comprised of submicron resin particles of styrene-butylacrylate-beta carboxyl ethyl acrylate particles dispersed in an ionic surfactant and water;

(v) adjusting the pH of the toner aggregates from about 2 to about 7 with a base;

(vi) heating the resulting aggregate suspension of above the Tg of the latex resin;

(vii) retaining the temperature of mixture (vi) from about 70° C. to about 95° C., followed by a reduction of the pH to about 5.5 and then retaining the temperature for a period of about 0.5 to about 6 hours allowing the fusion or coalescence of the toner aggregates, wherein the toner particle size and the particle size distribution thereof is substantially retained, and isolating the toner; a process wherein the polymetal halide is a polyaluminum chloride or a polymetal sulfosilicate; a process wherein the polymetal halide is a polyaluminum chloride, the polymetal sulfosilicate is a polyaluminum sulfo silicate and the multivalent salts thereof are aluminum silicate, zinc sulfate magnesium sulfate, magnesium chloride, and/or calcium chloride, and wherein submicron is from about 0.05 to about 1 micron in diameter; a security process further containing a cationic surfactant selected from a group consisting of dialkyl benzenealkyl ammonium chloride, lauryl trimethyl ammonium chloride, alkylbenzyl dimethyl ammonium chloride, alkyl benzyl dimethyl ammonium bromide, benzalkonium chloride, cetyl pyridinium bromide, trimethyl ammonium bromides, halide salts of quatemized polyoxyethylalkylamines, and dodecylbenzyl triethyl ammonium chloride; an emulsion aggregation toner process for the preparation of a security mark, which mark is a white glossy mark and is clearly distinguished or visible from a paper substrate, and is apparent at an angle of, for example, from about 10 through about 85 degrees irrespective of the light location when the light source is located across the viewing angle or behind the viewing or on top of the viewing angle, and which white glossy mark is, more specifically, viewed between the angles of about 35 to about 65 degrees and preferably from about 40 to about 60 degrees of the light source.

The security mark can appear as a white glossy reflecting surface and which mark can be located in various areas of the document and in various sizes, and wherein in embodiments a bar code can be placed thereover, and optionally, wherein the mark can be placed in any format on any part of the document, and is clearly visible to the naked eye when viewed at any angle. The mark can be generated with a number of various suitable components, and more specifically, by a toner comprised of a polymer, such as known toner polymers selected for xerography and a colorant, preferably a white colorant or pigment of, for example, titanium dioxide, and which security mark cannot be readily effectively reproduced. The toner selected can be prepared by a number of processes, such as the emulsion aggregation processes illustrated herein. Thus, in embodiments the toner selected can be formed by aggregating a colorant dispersion comprised of about 30 to about 65 percent colorant, about 70 to about 35 percent water, and from about 1 to about 5 pph of a nonionic surfactant, and wherein the colorant is, for example, a pigment of titanium dioxide particles, usually in the size range diameter of about 0.05 to about 0.70 micron suspended in aqueous phase in the presence of a dispersant. The aforementioned toners can then be applied xerographically to the document to be protected.

The security mark can be applied prior to generating the final document, during the preparation of the document, or subsequent to the preparation of the document. Optionally, in addition to the security mark illustrated herein, the document, such as a check, a coupon or other security document, may contain a second mark which when radiated by a light source, such as a UV light source, is rendered visible. The aforementioned second mark can be generated with, for example, a toner that contains an emitting component or a component that fluoresces in the about 400 to about 700 nanometers visible spectral region, such component being, for example, 4,4'-bis(styryl)biphenyl, 2-(4-phenylstilben-4-yl)-6-butylbenzoxazole, beta-methylumbelliferone, 4,-methyl-7-dimethylaminocoumarin, 4-methyl-7-aminocoumarin, N-methyl-4-methoxy-1,8-naphthalimide, 9,10-bis(phenethynyl)anthracene, 5,12-bis(phenethynyl)naphthacene, or DAYGLO INVISIBLE BLUE™ A-594-5, and the like. The toner usually contains the light emitter dissolved or finely dispersed in a polymer resin thereof. An example of a toner that may be selected for generating a security mark is comprised of a polymer resin in the amount of, for example, about 85 to about 65 percent by weight of toner, and more specifically, from about 80 to about 70 percent by weight of toner, and a pigment like titanium dioxide present, for example, in the amount of about 15 to about 35 weight percent by weight of toner, and more specifically, about 20 to 30 percent by weight of toner. A second toner for the generation of an additional security mark can comprise a polymer resin selected in an amount of about 90 to about 98 percent by weight of toner, and an emitter component of about 10 to about 2 percent by weight of toner, and wherein the toner for the first and second security marks may contain flow aids and charge control additives; a process wherein the amount of the white pigment, such as titanium dioxide $TiO_2$ used to generate the security mark either by a toner in a xerographic process, or by an ink by lithographic means, is, for example, in excess of about 40 percent by weight, for example from about 41 to about 65, of the formulation results in a reduction of the viewing angle by about 50 percent; a process wherein the security mark is clearly visible at angles between from about 0 to about 180 degrees, and more specifically, angles from about 45 to about 75 degrees, and yet more specifically, from about 40 to about 65 degrees when viewed by the eye irrespective to the location of the light source; for the formation of a security mark utilizing a xerographic toner containing a polymer having a molecular weight ($M_w$) of about 10,000 to about 40, 000, and more specifically, about 18,000 to about 35,000, and of a titanium dioxide pigment present in an amount of about 10 to about 40 percent, and more specifically, about 20 to about 30 weight percent by weight of toner; a process for providing a secondary security mark on a document, which mark fluoresces when illuminated with a UV light source; the secondary mark, which can be placed on a document, such as a coupon, in addition to the visible primary white glossy mark, provides a security mark or automatic checkout, wherein the coupon is authenticated by a barcode and the UV security mar; reproduced or duplicated copies will result in lack of both marks, indicating a fake or a counterfeit document.

The toners selected for the generation of the security mark can be obtained from various sources, and more specifically, these toners can be generated by the emulsion/aggregation/coalescing processes illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also U.S. Pat. Nos. 5,348,832; 5,405,728; 5,366,841; 5,496,676; 5,527,658; 5,585,215; 5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210.

Toner polymer examples include known polymers selected, for example, from the group consisting of poly (styrene-butadiene), poly(para-methyl styrenebutadiene), poly(meta-methyl styrene-butadiene), poly(alpha-methyl styrene-butadiene), poly(methylmethacrylate-butadiene), poly(ethylmethacrylate-butadiene), poly (propylmethacrylate-butadiene), poly(butylmethacrylate-butadiene), poly(methylacrylate-butadiene), poly (ethylacrylate-butadiene), poly(propylacrylate-butadiene), poly(butylacrylate-butadiene), poly(styrene-isoprene), poly (para-methyl styrene-isoprene), poly(meta-methyl styrene-isoprene), poly(alpha-methylstyrene-isoprene), poly (methylmethacrylate-isoprene), poly(ethylmethacrylate-isoprene), poly(propylmethacrylate-isoprene), poly (butylmethacrylate-isoprene), poly(methylacrylate-isoprene), poly(ethylacrylate-isoprene), poly (propylacrylate-isoprene), and poly(butylacrylate-isoprene); and terpolymers, such as poly(styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyesters, styrene acrylates, styrene methacrylates, and styrene butadienes.

The polymer particles selected, which generally can be in embodiments styrene acrylates, styrene butadienes, styrene methacrylates, or polyesters, are present in various effective amounts, such as from about 70 weight percent to about 99 weight, and more specifically, from about 75 to about 90 percent of the toner, and which toner can be of small average particle size, such as from about 0.01 micron to about 9 microns in average volume diameter as measured by the Brookhaven nanosize particle analyzer. Other effective amounts of resin can be selected. Also, the polymer selected for the process of the present invention can be prepared by, for example, emulsion polymerization techniques, including semicontinuous emulsion polymerization methods, and the monomers utilized in such processes can be selected from, for example, styrene, acrylates, methacrylates, butadiene, isoprene, and optionally, acid or basic olefinic monomers, such as acrylic acid, methacrylic acid, acrylamide, methacrylamide, quatemary ammonium halide of dialkyl or trialkyl acrylamides or methacrylamide, vinylpyridine, vinylpyrrolidone, vinyl-N-methylpyridinium chloride and the like. The presence of acid or basic groups in the monomer, or polymer resin is optional and such groups can be present in various amounts of from about 0.1 to about 10 percent by weight of the polymer resin. Chain transfer agents, such as dodecanethiol or carbon tetrabromide, can also be selected when preparing resin particles by emulsion polymerization. Other processes of obtaining the polymer particles of, for example, from about 0.01 micron to about 1 micron can be selected from polymer microsuspension process, such as those illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Examples of anionic surfactants selected for the toner preparation include, for example, sodium dodecylsulfate (SDS), sodium dodecylbenzene sulfonate, sodium dodecyinaphthalenesulfate, dialkyl benzenealkyl, sulfates and sulfonates, abitic acid, available from Aldrich, NEOGEN RK™, NEOGEN SC™ from Kao, and the like. An effective concentration of the anionic surfactant generally employed is, for example, from about 0.01 to about 10 percent by weight, and preferably from about 0.1 to about 5 percent by weight of monomers used to prepare the toner polymer resin.

Examples of nonionic surfactants that may be, for example, included in the resin latex dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. A suitable concentration of the nonionic surfactant is, for example, from about 0.01 to about 10 percent by weight, and preferably from about 0.1 to about 5 percent by weight of monomers used to prepare the toner polymer resin.

Coagulants that can be included in the toner in amounts of, for example, from about 1 to about 10 weight percent include polymetal halides, polymetal sulfosilicates monovalent, divalent or multivalent salts in combination with cationic surfactants, and the like.

Counterionic coagulants may be comprised of organic, or inorganic entities and the like. For example, in embodiments the ionic surfactant of the resin latex dispersion is an anionic surfactant, and the counterionic coagulant is a polymetal halide or a polymetal sulfo silicate (PASS).

Inorganic cationic coagulants include, for example, polyaluminum chloride (PAC), polyaluminum sulfo silicate (PASS), aluminum sulfate, zinc sulfate, or magnesium sulfate.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

The coagulant is in embodiments present in an aqueous medium in an amount of from, for example, about 0.05 to about 10 percent by weight, and more specifically, in an amount of from about 0.075 to about 2 percent by weight. The coagulant may also contain minor amounts of other components, for example nitric acid. The coagulant is usually added slowly into the blend while continuously subjecting the blend to high shear, for example by stirring with a blade at about 3,000 to 10,000 rpm, most preferably about 5,000 rpm, for about 1 to about 120 minutes. A high shearing device, for example an intense homogenization device, such as the in-line IKA SD-41, may be used to ensure that the blend is homogeneous and uniformly dispersed. Following homogenization, aggregation of the homogenized composition is effected by heating the composition to a temperature below the glass transition temperature (Tg) of the resin of the latex while agitating the composition. More specifically, the temperature of the heating is from, for example, about 5° C. to about 20° C. below the Tg of the resin. The agitating comprises continuously stirring the mixture using a mechanical stirrer set at between, for example, about 200 to about 800 rpm.

After aggregation the resulting particles are coalesced by, for example, first changing the pH to about 6 to about 8, followed by heating at a temperature above the Tg of the latex resin in the toner particles. The heating for coalescing can in embodiments be conducted at a temperature of from about 10° C. to about 50° C., from about 25° C. to about 40° C., above the Tg of the resin for a suitable period, such as for example, about 30 minutes to about 10 hours.

The solids content of the resin latex dispersion is not particularly limited. The solids content may be, for example, from about 10 to about 90 percent. With regard to the pigment, such as titanium dioxide, in some instances they are available in the wet cake or concentrated form containing water, and can be easily dispersed utilizing a homogenizer, simply by stirring, ball milling, attrition, or media milling. In other instances, pigments are available only in a dry form, whereby dispersion in water is effected by microfluidizing using, for example, a M-110 microfluidizer or an ultimizer and passing the pigment dispersion from about 1 to about 10 times through a chamber by sonication, such as using a Branson 700 sonicator, with a homogenizer, ball milling, attrition, or media milling with the optional addition of dispersing agents such as the aforementioned ionic or nonionic surfactants.

Various known pigments that can be selected include titanium dioxide, zinc oxide, other similar metal oxides, and the like. In embodiments, the pigment particles are present in the toner composition in an amount of from about 10 percent by weight to about 40 percent by weight, and preferably in the range of about 20 to about 30 percent calculated on the weight of the dry toner, and preferably from about 20 to about 30 weight percent by weight of toner. The white pigment can be titanium dioxide or aluminum oxide, zirconium oxide or zinc oxide, and the like.

The UV fluorescent component can be, for example, selected from the group consisting of 4,4'-bis(styryl) biphenyl, 2-(4-phenylstilben-4-yl)-6-butylbenzoxazole, beta-methylumbelliferone, 4-methyl-7-dimethylaminocoumarin, 4-methyl-7-aminocoumarin, N-methyl-4-methoxy-1,8-naphthalimide, 9,10-bis (phenethynyl)anthracene, 5,12-bis(phenethynyl) naphthacene, or DAYGLO INVISIBLE BLUE™ A-594-5, and the preferred one is DAYGLO INVISIBLE BLUE™, and the like.

For the optional additional security mark, the toner compositions can be prepared by using a fluorescing pigment, such as DAYGLO BLUE™, or 4,4'-bis(styryl)biphenyl, wherein the pigment submicron in size is suspended in water in the presence of an ionic surfactant which is then aggregated and coalesced with latex emulsion particles.

Moreover, in embodiments there are illustrated security marks generated with a toner containing a pigment, such as titanium dioxide, and wherein the toner can be prepared by emulsion/aggregation processes as illustrated herein, and wherein the toner is provided on a document, such as paper, utilizing xerographic processes. The resulting aforementioned mark document is then fused on, for example, a matte substrate, such as Xerox 4024 paper, or a glossy substrate, and wherein the mark possesses white shiny characteristics, and which mark is visible to the eye. When the document containing the security mark is copied, there results a copy without the white shiny or glossy secured mark. Therefore, the absence of the security mark on the copy or copies indicates that it is not authentic, a forgery, a counterfeit, or other nonauthorized copy. Furthermore, the toner used to generate the security marks can be prepared by other methods, such as suspension polymerization, dispersion polymerization, microencapsulation, by convention melt mixing or extrusion technologies.

Any suitable printing apparatus art may be employed to place the marks on the paper. More specifically, the printing apparatus can be an electrostatographic printing machine that incorporates six developer housings for the purposes of full color where each developer housing contains toner particles of a different color, that is black, yellow, magenta, cyan, a white glossy toner and a white UV fluorescent toner. Also, two or more printing engines requiring six developer housings can be selected to provide a full pictorial in addition to the security marks.

More specifically, with regard to two sided coupons, the first side usually contains a full color image of the product being offered or optionally a single color, which is printed on the paper, followed by printing on the reverse of the paper the conditions of coupon redemption, a barcode all in black ink, together with two white security ink marks. The security ink marks can be deposited in various combinations including placing a barcode on top of the white glossy mark with the UV fluorescing mark being placed next to the white glossy mark containing the bar code, or placing the barcode on top of the UV emitter mark with the white glossy mark placed next to the UV fluorescing mark containing the bar code. The security marks can optionally be placed in independent location of each other and in any area on the document, such as paper. Regarding a single sided coupon, there can be selected a printing machine with three ink stations, one containing a black ink for writing text messages and placing the barcode, a second developer housing containing a white glossy ink, and a third containing a UV emitter. For color a fourth ink station can be utilized. The barcode is usually placed on a white background for maximum contrast in order for the scanner to read the barcode. The security marks are hence placed next to the barcode or below the barcode. In all cases the coupons are usually full of color on one side while the reverse side is about 95 to about 99 percent white where the text information, such as addresses, or P.O box, including the barcode, are all printed in black .

The following Examples are being submitted to further define various species of the present invention. These Examples are intended to be illustrative only and are not intended to limit the scope of the present invention.

EXAMPLE I

A latex emulsion (i) comprised of polymer particles generated from the emulsion polymerization of styrene, butyl acrylate and beta carboxy ethyl acrylate (Beta CEA) was prepared as follows. A surfactant solution of 434 grams of DOWFAX 2A1™—disodium dodecyl diphenyloxide disulfonate (anionic emulsifier) and 387 kilograms of deionized water was prepared by mixing for 10 minutes in a stainless steel holding tank. The holding tank was then purged with nitrogen for 5 minutes before transferring the mixture into a reactor. The reactor was then continuously purged with nitrogen while being stirred at 100 RPM. The reactor was then heated to 80° C.

Separately, 6.11 kilograms of ammonium persulfate initiator were dissolved in 30.2 kilograms of deionized water. Also, separately a monomer emulsion A was prepared in the following manner. 315.7 Kilograms of styrene, 91.66 kilograms of butyl acrylate, 12.21 kilograms of beta-CEA, 7.13 kilograms of 1-dodecanethiol, 1.42 kilograms of decanediol diacrylate (ADOD), 8.24 kilograms of DOWFAX™ (anionic surfactant), and 193 kilograms of deionized water were mixed to form an emulsion. Five percent of the above emulsion was then slowly fed into the reactor containing the aqueous surfactant phase at 80° C. to form the seeds wherein the "seeds" refer, for example, to the initial emulsion latex added to the reactor, prior to the addition of the initiator solution, while being purged with nitrogen. The above initiator solution was then slowly charged into the reactor, forming about 5 to about 12 nanometers of latex "seed" particles. After 10 minutes, the remainder of the emulsion was continuously fed in using metering pumps.

Once all of the above monomer emulsion was charged into the main reactor, the temperature was maintained at 80° C. for an additional 2 hours to complete the reaction. The reactor contents were then cooled down to about 25° C. The resulting isolated product was comprised of 40 weight percent of submicron, 0.5 micron, diameter resin particles of styrene/butylacrylate/beta CEA suspended in 60 percent water and 1.5 pph of the anionic surfactant. The molecular properties resulting for the resin latex were $M_w$ of 39,000, $M_n$ of 10.8, as measured by a Gel Permeation Chromatograph, and a midpoint Tg of 55.8° C., as measured by a Differential Scanning Calorimeter, where the midpoint Tg is the halfway point between the onset and the offset Tg of the polymer.

EXAMPLE II

Preparation of White Toner

About 310 grams of the above prepared latex emulsion and 164 grams of an aqueous titanium dioxide ($TiO_2$) dispersion containing 64 grams of $TiO_2$ with a solids loading of 66.6 percent, and 33.4 percent water were simultaneously added to 600 milliliters of water with-high shear stirring by means of a polytron. To this mixture were added 11.25 grams of a polyaluminum sulfosilicate (PASS) solution containing 1.25 grams of PASS of 10 percent solids of polyaluminum sulfosilicate and 10 grams of 0.2 molar nitric acid, over a period of 1 minute, followed by the addition of 11.25 grams of a cationic surfactant solution containing 1.25 grams of the coagulant SANIZOL B™ (60 percent active ingredients) and 10 grams of deionized water and blended at speed of 5,000 rpm for a period of 3 minutes. The resulting mixture was transferred to a 2 liter reaction vessel and heated at a temperature of 45° C. for 110 minutes resulting in aggregates of a size diameter of 5.1 micrometers and a Geometric Standard Deviation ("GSD") of 1.20. To the resulting toner aggregates were added 130 grams of the above prepared latex followed by stirring for an additional 90 minutes; the temperature was then increased to 47° C. The particle diameter size of the aggregates was found to be 5.4 and a GSD of 1.19.

The pH of the resulting mixture was then adjusted from about 2 to about 7.9 with aqueous base solution of 4 percent sodium hydroxide and allowed to stir for an additional 15 minutes. Subsequently, the resulting mixture was heated to 93° C. and retained there for a period of 1 hour where the particle size of the formed aggregates was 5.6 micrometers with a GSD of 1.21. This was followed by the reduction of the pH to 5.5 with 5 percent nitric acid solution and followed by stirring for an additional 40 minutes. The diameter particle size of the formed aggregates measured was 5.7 micrometers with a GSD of 1.21. The pH of the mixture was further decreased to 5 and allowed to coalesce for an additional 1 hour, resulting in spherical particles with a size diameter of 5.7 micrometers and a GSD of 1.21. The reactor was then cooled down to room temperature, about 22 to about 25° C., and the resulting particles were washed 4 times with deionized water with the final wash at a pH of 4. The particles were then dried on a freeze dryer at a temperature of −80° C. for a period of 2 days. The toner particles obtained were comprised of 80 percent styrene butylacrylate BCEA resin and 20 percent titanium dioxide pigment.

EXAMPLE III (27 Percent $TiO_2$ Pigment)

310 Grams of the above prepared latex emulsion and 164 grams of an aqueous titanium dioxide ($TiO_2$) dispersion containing 97 grams of $TiO_2$ with a solids loading of 66.6 percent, were simultaneously added to 600 milliliters of water with high shear stirring by means of a polytron. To this mixture was added 11.25 grams of a polyaluminum sulfosilicate (PASS) solution containing 1.25 grams of PASS, 10 percent solids and 10 grams of 0.2 molar nitric acid, over a period of 1 minute, followed by the addition of 11.25 grams of cationic surfactant solution containing 1.25 grams of the coagulant SANIZOL B™ (60 percent active ingredients) and 10 grams of deionized water, and blended at a speed of 5,000 rpm for a period of 3 minutes. The resulting mixture was transferred to a 2 liter reaction vessel and heated at a temperature of 47° C. for 120 minutes resulting in aggregates of a size of 6 micrometers and a Geometric Standard Deviation ("GSD") of 1.19. To the toner aggregates were added 130 grams of the above prepared latex followed by stirring for an additional 90 minutes; the temperature was held at 47° C. The particle size of the aggregates was found to be 6.2 with a GSD of 1.19.

The pH of the resulting mixture was then adjusted from 2 to 7.9 with aqueous base solution of 4 percent sodium hydroxide and allowed to stir for an additional 15 minutes. Subsequently, the resulting mixture was heated to 93° C. and retained there for a period of 1 hour where the particle size measured was 6.2 micrometers with a GSD of 1.20. This was followed by the reduction of the pH to 5.8 with 4 percent nitric acid solution and allowed to stir for an additional 40 minutes. The particle size was 6.2 micrometers with a GSD of 1.20. The pH of the mixture was further decreased to 5, and allowed to coalesce for an additional 1 hour resulting in spherical particles with a size of 6.3 micrometers and a GSD of 1.21. The reactor was then cooled down to room temperature and the particle were washed 4 times with deionized water. The toner particles obtained were comprised of 73 percent styrene butylacrylate BCEA resin and 27 percent titanium pigment, and these particles dried on a freeze dryer at a temperature of −80° C. for a period of 2 days.

EXAMPLE IV (A UV Fluorescent)

310 Grams of the above prepared latex emulsion and 100 grams of an a UV fluorescent dispersion containing 9 grams of DAYGLO INVISIBLE BLUE™ pigment, 91 grams of water and 1 gram of anionic surfactant (NEOGEN RK™) were simultaneously added to 600 milliliters of water with high shear stirring by means of a polytron. To this mixture were added 11.25 grams of a polyaluminum sulfosilicate (PASS) solution containing 1.25 grams of PASS of 10 percent solids and 10 grams of 0.2 molar nitric acid, over a period of 1 minute, followed by the addition of 11.25 grams of cationic surfactant solution containing 1.25 grams of the coagulant SANIZOL B™ (60 percent active ingredients) and 10 grams of deionized water and blended at speed of 5,000 rpm for a period of 3 minutes. The resulting mixture was transferred to a 2 liter reaction vessel and heated at a temperature of 48° C. for 100 minutes resulting in aggregates of a size of 6.2 micrometers and a Geometric Standard Deviation ("GSD") of 1.19. To this toner aggregate were added 130 grams of the above prepared latex followed by stirring for an additional 90 minutes and the temperature was held at 47° C. The particle size was found to be 6.4 and a GSD of 1.19.

The pH of the resulting mixture was then adjusted from about 2 to about 7.9 with an aqueous base solution of 4 percent sodium hydroxide and allowed to stir for an additional 15 minutes. Subsequently, the resulting mixture was heated to 90° C. and retained there for a period of 1 hour where the particle diameter size was 6.4 micrometers with a GSD of 1.20. This was followed by the reduction of the pH to 5.8 with 4 percent nitric acid solution and followed by stirring for an additional 40 minutes.. The particle size measured was 6.4 micrometers with a GSD of 1.20. The pH of the mixture was further decreased to 5 and the mixture was allowed to coalesce for an additional 1 hour resulting in spherical particles with a size of 6.3 micrometers and a GSD of 1.21. The reactor was then cooled down to room temperature and the particles were washed four times with deionized water. The toner resulting was comprised of 95 percent styrene butylacrylate BCEA resin and 5 percent of the UV fluorescent pigment; this toner was then dried on a freeze dryer at a temperature of −80° C. for a period of 2 days.

EXAMPLE V

Preparing the Security Marks on Paper

A coupon containing a security mark was prepared in the following manner. Two xerographic engines were employed to prepare a full color coupon. The first engine, a Xerox Corporation DOCUCOLOR 12® (DC 12), having a 4 development housings containing cyan, yellow, magenta and a black toners, was utilized to provide an image in full color and then the image was fused to paper providing a full color print of the coupon, including the company logo. The paper containing the imaged coupon was then removed from the output tray of the first engine and fed into the second Xerox Corporation xerographic engine comprised of a two development housing, which contained a glossy white toner and a UV fluorescing toner respectivey. The resulting two white toner marks in form of circles of about 1 centimeter in diameter were imaged by placing them on either side of the company logo which circles were then fused by heat, thereby producing a full color coupon containing two white security marks. The white visible security glossy mark was comprised of 80 percent resin and 20 percent titanium dioxide by weight of toner, and the second white security mark was invisible and was rendered visible when illuminated with UV light.

This original coupon was then placed on a color copier and attempts to duplicate the coupon xerographically under various contrast conditions resulted in the absence of the white glossy mark or the mark appeared as a dull gray circle, indicating a fake coupon. The reproduced coupon when placed under a UV light was free of the original UV circular mark, indicating a forgery.

EXAMPLE VI

Preparing Two Security Marks on Paper

A coupon containing security marks was prepared in the following manner. Two xerographic engines were employed to prepare a full color coupon. The first engine with two development housings contained a glossy white toner and one contained a UV fluorescing toner. The white glossy image of the toner was laid on the coupon as a rectangle, which was 5 centimeters by 2 centimeters. The UV fluorescing toner was placed on the coupon as a circle, which was 1 centimeter in diameter next to the rectangular mark. Images were fused resulting in a white glossy rectangle, which was clearly visible to the eye while the UV mark was not. The fused image was then fed in a second xerographic engine, Xerox Corporation DOCUCOLOR 12 (DC 12), having 4 development housings with a cyan, a yellow, a magenta, and a black toner to provide a full color designed coupon, where a barcode was placed on top of the rectangle white glossy security mark while the text message containing conditions was partially laid over the UV mark. The imaged color coupon was then fused resulting in a full color coupon containing two security marks. The white glossy security mark containing the barcode was clearly visible to the eye. The same coupon when placed under UV light rendered the second mark visible as it fluoresced.

This original coupon was then placed on a color copier and attempts to duplicate the coupon xerographically under various contrast conditions resulted in the barcode being copied, but with the absence of the white glossy mark or the mark appeared as a dull gray rectangle, indicating a fake coupon. The reproduced coupon when placed under a UV light showed the absence of the UV circular mark, indicating a fake.

EXAMPLE VII

Preparing Two Security Marks on Paper

A coupon containing two security marks was prepared in the following manner. Two xerographic engines were employed to prepare a full color coupon. The first engine contained two development housings which contained a glossy white toner and a UV fluorescing toner, respectively. The white glossy image of the toner was placed on paper as "VALID COUPON" text at an angle of 45 degrees where each letter was 1 centimeter by 1 centimeter. The UV fluorescing toner was placed as a circle, which was 1 centimeter in diameter, next to VALID COUPON. The images were fused on paper where the image of "VALID COUPON" appeared as a white glossy mark, to the eye, while the UV mark was not visible. The fused image was then fed in a second xerographic engine, a Xerox Corporation DOCUCOLOR 12® (DC 12), with 4 development housings containing, respectively, a cyan, a yellow, a magenta, and a black, to provide a full color designed coupon, including the bar code. The text message containing the redemption conditions was placed over the "VALID COUPON" lettering.

The imaged color coupon was then fused resulting in a full color coupon containing two security marks. The white glossy security mark "VALID COUPON", which had the redemption text writing over it, was clearly visible to the eye. The same coupon when placed under the UV light rendered the second mark visible as it fluoresced.

This original coupon was then placed on the above DC 12 color copier and attempts to duplicate the coupon xerographically under various contrast conditions resulted in the barcode being copied but with the absence of the white glossy "VALID COUPON" mark, indicating a fake coupon. The reproduced coupon when placed under a UV light showed the absence of the UV circular mark, indicating a fake. It is desirable to place the security marks on a white background for ease of viewing.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process comprising applying a toner security mark on a document generated by xerographic means, and which mark possesses white glossy characteristics, and wherein said toner is comprised of a polymer and a colorant, and wherein said glossy is from about 65 to about 140 Gardner Gloss Units.

2. A process in accordance with claim 1 wherein said mark is present on a coupon, or currency.

3. A process in accordance with claim 1 wherein said colorant is a white pigment present in an amount of from about 10 to about 40 percent pigment, and said polymer is present in an amount of from about 90 to about 60 percent.

4. A process in accordance with claim 1 wherein said colorant is a white pigment present in an amount of from about 20 to about 30 percent pigment and said polymer is present in an amount of from about 80 to about 70 percent, and wherein the total of said two components is about 100 percent.

5. A process in accordance with claim 1 wherein said mark is visible when viewed at angles of from about 15 to about 85 degrees from the perpendicular.

6. A process in accordance with claim 5 wherein the viewing angle is from about 35 to about 65 degrees.

7. A process in accordance with claim 1 wherein the polymeric resin possesses a molecular weight $M_w$ of about 15,000 to about 40,000.

8. A process in accordance with claim 1 further including a second security mark containing a polymer and a UV fluorescent colorant.

9. A process in accordance with claim 8 wherein the colorant is a white pigment of titanium dioxide, aluminum oxide, zirconium oxide or zinc oxide.

10. A process in accordance with claim 1 wherein the white pigment is titanium dioxide present in an amount of about 20 to about 30 percent by weight of toner, and there is present about 80 to about 70 percent polymer resin.

11. A process in accordance with claim 1 wherein there is further added a second security mark comprised of a UV excited fluorescent pigment present in an amount of about 2 to about 10 weight percent by weight of toner.

12. A process in accordance with claim 11 wherein the UV excited fluorescent pigment is present in an amount of about 3 to about 8 weight percent by weight of toner.

13. A process in accordance with claim 11 wherein the UV fluorescent pigment is initially invisible, and subsequently rendered visible when subjected to UV light.

14. A process in accordance with claim 8 wherein the pigment is selected from the group consisting of 4,4'-bis(styryl)biphenyl, 2-(4-phenylstilben-4-yl)-6-butylbenzoxazole, beta-methylumbelliferone, 4-methyl-7-dimethylaminocoumarin, 4-methyl-7-aminocoumarin, N-methyl-4-methoxy-1,8-naphthalimide, 9,10-bis(phenethynyl)anthracene, and 5,12-bis(phenethynyl)naphthacene.

15. A process in accordance with claim 1 wherein the polymer is a styrene-butylacrylate-beta carboxyl ethyl acrylate.

16. A process comprising applying a security mark on a document and which mark possesses white glossy characteristics, and wherein said mark is visible and contains a pigment embedded in a polymer and a second toner mark which contains a colorant that fluoresces under UV light, and wherein said glossy is from about 65 to about 140 Gardner Gloss Units.

17. A process comprising providing a security mark or marks on a document generated xerographically, and which mark is comprised of a glossy toner containing a polymer and a pigment, and wherein said glossy is from about 65 to about 140 Gardner Gloss Units.

18. A process in accordance with claim 1 wherein said polymer is a styrene acrylate, a styrene methacrylate, a styrene butadiene, or a polyester.

19. A process in accordance with claim 1 wherein said polymer is a styrene acrylate.

20. A process in accordance with claim 1 wherein said polymer is a methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

21. A process in accordance with claim 1 wherein said polymer is present in an amount of from about 65 to about 85 weight percent.

22. A process in accordance with claim 1 wherein said glossy value is from about 65 to about 99 GGU as measured at an angle of 75 degrees.

23. A process in accordance with claim 1 wherein said glossy value is from about 75 to about 140 GGU as measured at an angle of 75 degrees.

24. A process in accordance with claim 8 wherein said polymer is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrenebutadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

25. A process in accordance with claim 8 wherein a barcode is contained on the surface of said security mark.

26. A process in accordance with claim 25 wherein said barcode is situated below said UV fluorescent security mark.

27. A process in accordance with claim 1 wherein said security mark is located at various positions on the document.

28. A process in accordance with claim 1 wherein a second security mark is contained on said document, and which security mark contains a UV sensitive pigment.

29. A process in accordance with claim 1 wherein said security mark is located at various positions on the document.

30. A process for avoiding the copying of a document by providing a security mark on said document, and which mark is comprised of a glossy toner containing a pigment and optionally a second mark containing a UV sensitive pigment, and wherein said glossy is from about 65 to about 140 Gardner Gloss Units.

31. A process in accordance with claim 30 wherein the documents are tickets, coupons, identification badges, passes, or negotiable securities.

32. A process in accordance with claim 1 wherein the mark is viewed at an angle of from about 15 to about 85 degrees of the light source.

33. A process in accordance with claim 1 wherein said white glossy mark is generated from a toner which is prepared by (i) blending a latex emulsion with a white colorant dispersion comprised of submicron particles suspended in a nonionic surfactant and water, and optionally adding a wax dispersion comprised of submicron wax particles dispersed in an ionic surfactant of a similar charge polarity to that of the ionic surfactant in said latex emulsion, and wherein said latex contains submicron resin particles, an ionic surfactant and water;

(ii) adding to said blend two coagulants of a polymetal halide dissolved in a strong acid and an ionic surfactant of opposite charge polarity to that of the latex surfactant and pigment ionic surfactant to initiate flocculation of said latex and said white particles;

(iii) heating the resulting mixture below the glass transition temperature (Tg) of the latex resin to form toner sized aggregates;

(iv) optionally adding a latex to the formed toner aggregates;

(v) adjusting the pH of the toner aggregates from about 1.8 to about 3 to a pH value of about 6.5 to about 8 with a base;

(vi) heating the resulting aggregate suspension of (v) to above the Tg of the latex resin; and (vii) retaining the temperature of said mixture (vi) from about 70 to about 95° C., followed by a reduction of the pH to about 4.8 to about 6, and then optionally retaining the temperature for a period of about 0.5 to about 6 hours.

34. A process in accordance with claim 1 wherein said colorant is a UV fluorescent component, and wherein said toner is prepared by (i) blending a latex emulsion with a UV fluorescent component comprised of submicron particles suspended in nononic surfactant and water, and optionally adding a wax dispersion comprising submicron wax particles dispersed in an ionic surfactant of similar charge polarity to that of the ionic surfactant in said latex emulsion; and wherein said latex is comprised of submicron resin particles of styrene-butylacrylate-beta carboxyl ethyl acrylate dispersed in an ionic surfactant and water;

(ii) adding to said blend a polyaluminum chloride dissolved in nitric acid and an ionic surfactant of opposite charge polarity to that of the latex surfactant blend to initiate flocculation of latex and pigment particles;

(iii) heating the resulting mixture below the glass transition temperature (Tg) of the latex resin;

(iv) optionally adding a latex comprised of submicron resin particles of styrene-butylacrylate-beta carboxyl ethyl acrylate particles dispersed in an ionic surfactant and water;

(v) adjusting the pH of the toner aggregates from about 2 to about 7 with a base;

(vi) heating the resulting aggregate suspension of above the Tg of the latex resin;

(vii) retaining the temperature of mixture (vi) from about 70° C. to about 95° C., followed by a reduction of the pH to about 5.5 and then retaining the temperature for a period of about 0.5 to about 6 hours allowing the fusion or coalescence of the toner aggregates, wherein the toner particle size and the particle size distribution thereof is substantially retained, and isolating the toner.

35. A process in accordance with claim 33 wherein said polymetal halide is a polyaluminum chloride or a polymetal sulfosilicate.

36. A process in accordance with claim 33 wherein the polymetal halide is a polyaluminum chloride, the polymetal sulfosilicate is a polyaluminum sulfo silicate and the multivalent salts thereof are aluminum silicate, zinc sulfate magnesium sulfate, magnesium chloride, and/or calcium chloride, and wherein submicron is from about 0.05 to about 1 micron in diameter.

37. A process in accordance with claim 35 further containing a cationic surfactant selected from a group consisting of dialkyl benzenealkyl ammonium chloride, lauryl trimethyl ammonium chloride, alkylbenzyl dimethyl ammonium chloride, alkyl benzyl dimethyl ammonium bromide, benzalkonium chloride, cetyl pyridinium bromide, trimethyl ammonium bromides, halide salts of quaternized polyoxyethylalkylamines, and dodecylbenzyl triethyl ammonium chloride.

38. A process comprising applying a dry toner security mark on a document generated by xerographic means, and which mark possesses white glossy characteristics, and wherein said toner is comprised of a polymer and a colorant, and wherein said glossy is from about 65 to about 140 Gardner Gloss Units.

* * * * *